US010134215B2

(12) United States Patent
Chosson et al.

(10) Patent No.: US 10,134,215 B2
(45) Date of Patent: Nov. 20, 2018

(54) SECURITY DEVICE FOR SECURITY DOCUMENT

(71) Applicant: ORELL FÜSSLI SICHERHEITSDRUCK AG, Zürich (CH)

(72) Inventors: Sylvain Chosson, Zürich (CH); Dieter Sauter, Dietikon (CH)

(73) Assignee: ORELL FUSSLI SICHERHEITSDRUCK AG, Zurich (CH)

( * ) Notice: Subject to any disclaimer, the term of this patent is extended or adjusted under 35 U.S.C. 154(b) by 246 days.

(21) Appl. No.: 15/107,701

(22) PCT Filed: Dec. 22, 2014

(86) PCT No.: PCT/CH2014/000179
§ 371 (c)(1),
(2) Date: Jun. 23, 2016

(87) PCT Pub. No.: WO2015/095978
PCT Pub. Date: Jul. 2, 2015

(65) Prior Publication Data

US 2016/0328904 A1 Nov. 10, 2016

(30) Foreign Application Priority Data

Dec. 23, 2013 (WO) ..... PCT/CH2013/000231

(51) Int. Cl.
*B42D 25/00* (2014.01)
*B42D 15/00* (2006.01)
(Continued)

(52) U.S. Cl.
CPC ..... *G07D 7/128* (2013.01); *B41M 3/14* (2013.01); *B42D 15/00* (2013.01); *B42D 25/00* (2014.10);
(Continued)

(58) Field of Classification Search
CPC ..... B42D 2033/14
(Continued)

(56) References Cited

U.S. PATENT DOCUMENTS 5,449,200 A 9/1995 Andric et al.
6,036,233 A 3/2000 Braun et al.
(Continued)

FOREIGN PATENT DOCUMENTS

DE 195 41 064 A1 5/1997
DE 102 60 124 A1 7/2004
(Continued)

OTHER PUBLICATIONS

International Search Report dated Jan. 31, 2013 for International Application No. PCT/CH2012/000073.
(Continued)

*Primary Examiner* — Kyle R Grabowski
(74) *Attorney, Agent, or Firm* — Ladas & Parry LLP

(57) ABSTRACT

A security device for verifying an authenticity of a security document comprises an at least partially transparent substrate with a first surface and a second surface. A first pattern is arranged on the first surface. This first pattern is derivable using a first seed pattern. A second pattern is arranged on said second surface. This second pattern is derivable using the first seed pattern and using a second seed pattern. Transmittances and reflectivities of the first and second patterns are selected such that in a reflection viewing mode, only the first seed pattern is visible. In a transmission viewing mode, however, only the second seed pattern is visible.

7 Claims, 8 Drawing Sheets

(51) Int. Cl.

| | |
|---|---|
| ***G07D 7/128*** | (2016.01) |
| ***B42D 25/29*** | (2014.01) |
| ***B42D 25/351*** | (2014.01) |
| ***B41M 3/14*** | (2006.01) |
| ***G07D 7/06*** | (2006.01) |
| ***G07D 7/12*** | (2016.01) |
| ***B42D 25/24*** | (2014.01) |
| ***G07D 7/00*** | (2016.01) |

(52) U.S. Cl.
CPC ..... *B42D 25/24* (2014.10); *B42D 25/29* (2014.10); *B42D 25/351* (2014.10); *G07D 7/003* (2017.05); *G07D 7/06* (2013.01); *G07D 7/12* (2013.01); *B41M 3/148* (2013.01); *B42D 2035/26* (2013.01); *B42D 2035/36* (2013.01)

(58) Field of Classification Search
USPC ..... 283/93, 114
See application file for complete search history.

(56) References Cited

U.S. PATENT DOCUMENTS

| | | | | |
|---|---|---|---|---|
| 6,089,614 | A | 7/2000 | Howland et al. | |
| 6,827,283 | B2 | 12/2004 | Kappe et al. | |
| 2006/0197990 | A1 | 9/2006 | Myodo et al. | |
| 2010/0164219 | A1 | 7/2010 | Jeacock et al. | |
| 2012/0182443 | A1 | 7/2012 | Vincent | |
| 2013/0181435 | A1 | 7/2013 | Hersch et al. | |
| 2015/0244727 | A1* | 8/2015 | Fournel | B42D 25/21 380/54 |

FOREIGN PATENT DOCUMENTS

| | | | |
|---|---|---|---|
| EP | 0 310 707 | A2 | 4/1989 |
| EP | 0 628 408 | A1 | 12/1994 |
| EP | 2 522 529 | A2 | 11/2012 |
| WO | 97/47478 | A1 | 12/1997 |
| WO | 1997/47487 | | 12/1997 |
| WO | 98/15418 | A1 | 4/1998 |
| WO | 02/27647 | A1 | 4/2002 |
| WO | 2009/010714 | A1 | 1/2009 |
| WO | 2009/056351 | A1 | 5/2009 |
| WO | 2009/056355 | A1 | 5/2009 |
| WO | 2011/007343 | A1 | 1/2011 |
| WO | 2014/041298 | A2 | 3/2014 |

OTHER PUBLICATIONS

International Search Report and Written Opinion of the International Searching Authority dated Sep. 19, 2014 for International Application No. PCT/CH2013/000230.
International Search Report dated Sep. 19, 2014 for International Application No. PCT/CH2013/000231.
International Preliminary Report on Patentability dated Oct. 1, 2014 for International Application No. PCT/CH2012/000073.
International Search Report and Written Opinion of the International Searching Authority dated Feb. 2, 2015 for International Application No. PCT/CH2014/000078.
International Search Report and Written Opinion of the International Searching Authority dated Mar. 16, 2015 for International Application No. PCT/CH2014/000053.
International Search Report and Written Opinion of the International Searching Authority dated Mar. 16, 2015 for International Application No. PCT/CH2014/000179.
International Preliminary Report on Patentability dated Jun. 28, 2016 for International Application No. PCT/CH2013/000231.
English translation of DE 102 60 124 A1.
Espacenet English abstract of WO 2009/056351 A1.
English translation of WO 2009/056351 A1.
Espacenet English abstract of EP 2 522 529 A2.
English translation of EP 2 522 529 A2.
Espacenet English abstract of WO 2009/056355 A1.
English translation of WO 2009/056355 A1.
English translation of EP 1 580 025 A2.
Chosson, S., et al., "See-through images", Optical Documents Security, 2014, pp. 1-8.
Machizaud, J., et al., "Spectral transmittance model for stacks of transparencies printed with halftone colors", Color Imaging XII: Processing, Hardcopy and Applications, 2012, 10 pages.
Machizaud, J., et al., "Spectral reflectance and transmittance prediction model for stacked transparency and paper both printed with halftone colors", Optical Society of America, vol. 29, No. 8, Aug. 2012, pp. 1537-1548.
English Abstract of WO 1997/47487.

* cited by examiner

SECURITY DEVICE FOR SECURITY DOCUMENT

CROSS-REFERENCE TO RELATED APPLICATION

This U.S. application claims priority under 35 U.S.C. 371 to, and is a U.S. National Phase application of, the International Patent Application No. PCT/CH2014/00179, filed 22 Dec. 2014 which claims priority from CH PCT/CH2013/000231 file 23 Dec. 2013, the entire content of the above-mentioned patent application is incorporated by reference as part of the disclosure of this U.S. application.

TECHNICAL FIELD

The invention relates to a security device for verifying an authenticity of a security document as well as to a security document, e.g., a banknote, a passport, a document of value, a certificate, or a credit card which comprises such a security device. Furthermore, the invention relates to a method for generating such a security device as well as to a method for verifying the authenticity of a security document.

BACKGROUND ART

US 2006/0197990 A1 discloses a superposition of two tally images, thus revealing a hidden image. The hidden image cannot be reconstructed from a single tally image.

WO 97/47487 describes a security device having two simple patterns printed on opposite sides of a substrate, which generate different images when seen in reflection and transmission.

DISCLOSURE OF THE INVENTION

It is an object of the present invention to provide a security device for verifying an authenticity of a security document. Another object of the invention is to provide a method for generating such a security device. Yet another object of the invention is to provide a security document comprising such a security device. Yet another object of the invention is to provide a method for verifying the authenticity of such a security document.

These objects are achieved by the devices and the methods of the independent claims.

Accordingly, a security device for verifying an authenticity of a security document (such as a banknote, a passport, a document of value, a certificate, or a credit card) comprises an at least partially transparent substrate with a first surface and a second surface. The substrate is partially reflecting in a reflection viewing mode.

Herein, the terms "at least partially transparent" as well as "partially reflecting" relate to an optical property of a nonzero transmission and nonzero reflection, respectively, of light at at least one wavelength, in particular in the visible regime between 380 nm and 780 nm. Thus, in a transmission viewing mode, a nonzero amount of light can be shone through said substrate, and at least part of the light is also reflected. Advantageously, a transmittance of the substrate is higher than 50%, at least for one transmitted wavelength (which is in particular in the visible regime between 380 nm and 780 nm).

Advantageously, the substrate is flat and/or flexible (e.g., its thickness is smaller than 500 μm, in particular smaller than 120 μm) and the second surface can be on the opposite side of a flat substrate than the first surface. This simplifies the application in security documents which are usually flat and/or flexible to some degree.

Furthermore, the security device comprises a first pattern (e.g., a halftone, grayscale, or a color image) which is arranged on said first surface of said substrate. The first pattern may be derivable using a first seed pattern, i.e. the first pattern on the substrate may be generated using the first seed pattern (e.g., a halftone, grayscale, or a color image).

The first pattern has a plurality of color densities d1, i.e. it is non-uniform.

The first pattern has, for said at least one wavelength, a plurality of different color densities d1 (gray levels) d1 in a range between 0% (i.e. d1=0) and a given density level. This given density level is larger than 0% and smaller than 100%. Advantageously, it lies between 10% and 90% (i.e. between 0.1 and 0.9), in particular at 50% (i.e. at 0.5).

Furthermore, the security device comprises a second pattern (e.g., again, a halftone, grayscale, or a color image) which is arranged on said second surface of said substrate, e.g., opposite said first surface (see above). The second pattern may be derivable using the first seed pattern and a second seed pattern which is different from the first seed pattern, i.e. the second pattern on the substrate may be generated using the first seed pattern and a second seed pattern (e.g., again, a halftone, grayscale, or a color image).

The second pattern has a plurality of color densities d2, i.e. it is non-uniform.

Even though the color densities d2 of the second pattern can vary over a broad range, in particular even over a range between 0 and 1, they are not independent of the color densities d1 at the corresponding locations of the first pattern. Rather, they are such that, at said at least one wavelength, a "transmission-superposed pattern" formed by viewing the two patterns in transmission, has a plurality of color densities $b=1-(1-d1)*(1-d2)*t$ in a range between said given density level and 100%, with t being a factor between 0.5-1.0. In particular, factor t may be used to compensate for a non-perfect substrate transmission.

In particular, each pattern comprises a plurality of distinct regions (e.g., pixels) with a uniform visual appearance in each region. This enhances the information content of the patterns.

According to the invention, transmittances and reflectivities of said first pattern and of said second pattern are selected such that in a transmission viewing mode, for at least one transmitted wavelength (in particular in the visible regime between 380 nm and 780 nm) through said second pattern, through said substrate, and through said first pattern (i.e., through the whole security device), said second seed pattern is visible (i.e., at least some of its information content is reproducible). Brightness and contrast levels can be different from those of the second seed pattern, however.

As an effect, a transmission-mode-viewer (e.g., a naked eye of a viewer without visual aids or a viewing device such as a camera-equipped cellphone) can discern at least some different regions (e.g., pixels) in the visible pattern in the transmission viewing mode such that he can reproduce at least some of the information content of the second seed pattern. E.g., the pattern he acquires in the transmission viewing mode corresponds to the second seed pattern from which the second pattern is derivable. However, as stated above, a brightness and/or contrast can be different.

As an example for "visibility", i.e., for a discernibility of different regions in the pattern, e.g., ΔE94-values for the different regions are above 1.8.

However, transmittances and reflectivities of said first pattern and of said second pattern may furthermore selected such that in a reflection viewing mode, for at least one reflected wavelength (in particular in the visible regime between 380 nm and 780 nm, the wavelength is advantageously the same wavelength than the transmitted wavelength discussed above) from said first pattern, said first seed pattern is visible (i.e., at least some of its information content is reproducible).

As an effect, a reflection-mode-viewer (e.g., a naked eye of a viewer without visual aids or a viewing device such as a camera-equipped cellphone) can discern at least some different regions in the visible pattern in the reflection viewing mode. The pattern he acquires in the reflection viewing mode, e.g., corresponds to the first seed pattern from which the first pattern is derivable. However, a brightness and/or contrast can be different.

As an effect, according to the invention, the visual appearance and reconstructable information content of the security device depends on the viewing mode and security is thus enhanced considerably.

Advantageously, in the transmission viewing mode, only the second seed pattern is visible. Thus, the pattern can be seen more clearly as it is not contaminated by, e.g., leftovers from the first seed pattern.

In another advantageous embodiment, in the reflection viewing mode, only the first seed pattern is visible. Thus, the pattern can be seen more clearly as it is not contaminated by, e.g., leftovers from the second seed pattern.

Advantageously, the substrate comprises multiple layers with the same or different optical properties (such as transmission spectra). Thus, more specific effects can be realized and security is enhanced.

Advantageously, the first and/or the second pattern can be covered with one or more additional layer(s), e.g., for reducing or enhancing specular reflections from the first and/or second substrate surface(s) and/or pattern(s).

In an advantageous embodiment of the security device, the first pattern is applied, in particular printed (e.g., via offset printing, screen printing, or sublimation printing), onto said first surface of said substrate and/or the second pattern is applied, in particular printed (e.g., via offset printing or screen printing, or sublimation printing), onto said second surface of said substrate. Thus, the security device can be manufactured more easily.

Optionally, a primer layer can be applied below the first and/or second pattern in order to ensure the stability of the printed inks.

In another advantageous embodiment of the security device, the second seed pattern is invisible in said reflection viewing mode. This is particularly then the case when an overall (i.e., spatially integrated over the whole security device) reflected light intensity from the security device or from the first pattern outshines an overall (i.e., spatially integrated over the whole security device) transmitted light intensity through said security device at least by a factor of 5. In other words, in this embodiment, a definition for "reflection viewing mode" is that the overall reflected light intensity from the security device or from the first pattern outshines an overall transmitted light intensity through the security device at least by the above-mentioned factor.

Thus, it is easier to select the transmittances and reflectivities of the first and second pattern such that the above-discussed visual appearance effects occur in the reflection viewing mode.

In yet another advantageous embodiment of the security device, the first seed pattern is invisible in said transmission viewing mode. This is particularly then the case when an overall (i.e., spatially integrated over the whole security device) transmitted light intensity through the security device (in the transmission viewing mode) outshines an overall (i.e., spatially integrated over the whole security device) reflected light intensity from the security device or from the first pattern at least by a factor of 5. In other words, in this embodiment, a definition for "transmission viewing mode" is that the overall transmitted light intensity through the security device outshines an overall reflected light intensity from the security device at least by the above-mentioned factor.

Thus, it is easier to select the transmittances and reflectivities of the first and second patterns such that the above-discussed visual appearance effects occur in the transmission viewing mode.

Advantageously, the second pattern is derivable using—in addition to the second seed pattern—an inversion of said first seed pattern.

Herein, the term "inversion", "inverted", and, respectively, "inverted transmittance" and "inverted reflectivity" relate to a transmittance/reflectivity value (e.g., of a pattern or a specific region of a pattern) which is "inverted" with respect to an ideal 100% transmission/reflection at one or more wavelength(s) (in particular in the visible regime between 380 nm and 780 nm) and with respect to another transmittance/reflectivity value (e.g., that of another pattern or region). As examples, for a 90% transmittance of a specific region of the first seed pattern, an inverted transmittance would be 10%. As another example, a 20% reflectivity of a specific region is inverted with respect to an 80%) reflectivity.

Thus, it is easier to select the transmittances and reflectivities of the first and second patterns such that the above-discussed visual appearance effects occur in the transmission and reflection viewing modes of the security device.

In an advantageous embodiment of the security device, a first histogram (i.e., a graph indicative of an absolute or relative frequency-distribution of specific transmittance/reflectivity-values, e.g., gray levels) of said first pattern comprises at least a first unpopulated region and at least a first populated region. In other words, as an example, a first histogram of a first-pattern-gray-level-image comprises unpopulated gray levels, i.e., not all gray levels are present in the image (but some are!).

Thus, it is easier to select the transmittances and reflectivities of the first and second patterns such that the above-discussed visual appearance effects occur in the transmission and reflection viewing modes of the security device.

In another advantageous embodiment of the security device, the first pattern and/or the second pattern and/or the substrate comprises a color filter. This makes it easier to select one or more transmitted and/or reflected wavelength(s).

As another aspect of the invention, a method for generating a security device as described above comprises steps of providing a first seed pattern, providing a second seed pattern, modifying, if required, a brightness and/or a contrast of said first seed pattern for yielding said a pattern which is to be arranged on a substrate of the security device. The first pattern has a color densities d1 in a range between 0% and a given density level, wherein said given density level lies between 10% and 90%. This given density level advantageously lies between 10% and 90% (i.e. between 0.1 and 0.9), in particular at 50% (i.e. at 0.5).

Furthermore, the method comprises a step of modifying, if required, a brightness and/or a contrast of the second seed pattern for yielding an intermediate pattern. This intermediate pattern is, however, unlike the first pattern not directly to be arranged on the substrate of the security device (see below). It has color densities b in a range between said given density level and 100%.

The method comprises a further step of generating the second pattern (which is to be arranged on the second surface of the substrate of the security device) using the first pattern and using the intermediate pattern. This is done such that, for at least one wavelength, the color densities d2 of the second pattern are given by $d2=1-(1-b)/[t*(1-d1)]$, with t being a factor between 0.5-1.0.

Finally, the method comprises the steps of applying said first pattern (10) to a first surface of an at least partially transparent substrate (2) that is partially reflecting in a reflection viewing mode, and applying said second pattern (20) to a second surface of said substrate (2).

Hence, in a transmission viewing mode, for said at least one wavelength transmitted through said second pattern, through the substrate, and through said first pattern, said second seed pattern (in particular only the second seed pattern) is visible. In other words, the combined transmittances of the first and second patterns correspond to the second seed pattern (with a contrast/brightness degree-of-freedom).

Furthermore, it is ensured that in a reflection viewing mode, for said at least one reflected wavelength from the first pattern (advantageously the same wavelength as the transmitted wavelength), said first seed pattern (in particular only the first seed pattern) is visible. In other words, the second pattern is suppressed in the reflection viewing mode and reflectivities of the first pattern yield (with a contrast/brightness degree-of-freedom) yield the first seed pattern.

Thus, first and second patterns which have transmittances and reflectivities as discussed above are easier to generate. Thus, the above-discussed visual appearance effects in the transmission and reflection viewing modes of the security device are easier to achieve.

In an advantageous embodiment, the method comprises further steps of halftoning said first pattern, and halftoning said intermediate pattern or said second pattern.

Thus, grayscale images can be applied as halftone-images which simplifies manufacturing of the security device.

As another aspect of the invention, a security document (e.g., a banknote, a passport, a document of value, a certificate, or a credit card) comprises a security device as described above. The security device is advantageously arranged in a window (i.e., a transparent region) of (the substrate of) the security document. As an effect, the visual appearance and reconstructable information content of the security document can be more easily made dependent on the viewing mode. Thus, security is enhanced and counterfeiting is considerably aggravated.

Advantageously, such a security document further comprises a light absorber, in particular arranged at a distance to the security device. Then, for example by folding the security document along an applied, in particular printed, folding line, the light absorber can be brought into an overlap with the security device, in particular on a side of the second surface of the substrate of the security device. As an effect, the amount of transmitted light is reduced by the light absorber and thus a reflection viewing mode is reached more easily. As an effect, handling is improved when the authenticity of the security document is to be checked.

Advantageously, the light absorber has a reflectivity of less than 50% at least for said at least one reflected wavelength from said security device and/or the light absorber has a transmittance of less than 50% at least for said at least one transmitted wavelength through said security device. The light absorber can, e.g., comprise a region of the security document which is covered by a dark color, e.g., 100% black. As an effect, the reflection viewing mode of the security device is reached more easily and handling is improved when the authenticity of the security document is to be checked.

As another aspect of the invention, a method for verifying an authenticity of a security document as described comprises steps of providing the security document which comprises a security device as described above, from a first viewing position acquiring a first image of said security device in a transmission viewing mode (e.g., against a ceiling lamp), from a second viewing position (which can be the same or a different position than the first viewing position) acquiring a second image of said security device in a reflection viewing mode. Hereby, the first pattern is oriented towards the second viewing position.

Furthermore, the method comprises a step of deriving said authenticity of said security document using the first (transmission viewing mode) image and using the second (reflection viewing mode) image.

Because of the specific and different visual appearances in transmission viewing mode (second seed pattern is visible) and reflection viewing mode (first seed pattern in visible), the authenticity of the security document is easier to derive, security is enhanced, and counterfeiting is aggravated.

Advantageously, during the step of acquiring said second image, an overall (i.e., spatially integrated) reflected light intensity from said security device outshines an overall transmitted light intensity through said security device at least by a factor of 5. Thus, the reflection viewing mode is easier to establish.

In another advantageous embodiment, during said step of acquiring said first image, an overall (i.e., spatially integrated) transmitted light intensity through said security device outshines an overall reflected light intensity from said security device at least by a factor of 5. Thus, the transmission viewing mode is easier to establish.

Advantageously, the method comprises a step of bringing a light absorbing device into an overlap with said security device. Thus, an amount of transmitted light through the security device is reduced and the reflection viewing mode is easier to establish. Then, the step of acquiring said second image of said security device is carried out with said light absorbing device being arranged in said overlap with said security device, e.g., opposite said second viewing position near the second surface of the substrate of the security device. This simplifies the handling of the security document for acquiring the reflection viewing mode image.

The factor t used in the method and device can e.g. be chosen to be equal to 1, in particular if reflection effects of the substrate are negligible or if they are intentionally neglected.

In another embodiment, factor t may be between 0.5 and 0.9 and correspond to the transmission of the substrate. In this case, the effect of a non-perfect transmission of the substrate is neglected.

The substrate is partially reflecting, thus allowing to view recognize an image in reflection viewing mode.

In one embodiment, the reflection of the substrate can be caused by specular reflection, i.e. the substrate exhibits specular reflection in said reflection viewing mode. This allows to obtain reflection images of strong contrast when viewing the substrate under an angle where a light source is reflected to.

In another embodiment, the substrate exhibits at least 10% but no more than 50% reflection in said reflection viewing mode at said at least one wavelength. This allows to obtain reflection images of strong contrast.

Advantageously, the substrate should exhibit at least 10%, in particular at least 20%, and/or no more than 50% reflection at said at least one wavelength for light reflected perpendicularly to the substrate.

In another advantageous embodiment, the substrate is non-absorbing at the at least one wavelength, i.e. it absorbs light transmitted perpendicularly through the substrate by no more than 10%, in particular by no more than 5%. This is based on the understanding that an absorbing substrate leads to poorer image contrast in reflection viewing mode.

In another embodiment, the substrate exhibits at least 10%, in particular at least 20%, diffuse reflection, and/or it exhibits no more than 50% diffuse reflection in said reflection viewing mode at said at least one wavelength. This allows to obtain reflection images of strong contrast when viewing the substrate under any angle.

The first and second patterns are advantageously halftoned patterns, i.e. patterns applied in halftone technology.

The first and second patterns are advantageously applied by an absorbing, i.e. "black" ink, i.e. an ink that absorbs the light at said at least one wavelength.

The "given density level" is advantageously 50%, which allows to distribute the available contrast evenly between the transmitted and reflected images.

As mentioned, each of said first and second patterns has a plurality of color densities d1, d2, i.e. they are non-uniform. Advantageously, each pattern has at least three different color densities as a function of position, i.e. there are at least three different positions within each pattern that have at least three different color densities.

Remarks:

The invention is not limited to halftone or grayscale patterns. Although the description and figures herein mainly focus on halftone and grayscale patterns for the sake of clarity, analogous considerations can be made for each color channel of color patterns which renders the subject-matter of the invention feasible for color patterns.

The described embodiments similarly pertain to the devices and the methods. Synergetic effects may arise from different combinations of the embodiments although they might not be described in detail.

BRIEF DESCRIPTION OF THE DRAWINGS

The invention will be better understood and objects other than those set forth above will become apparent when consideration is given to the following detailed description thereof. Such description makes reference to the annexed drawings, wherein.

MODES FOR CARRYING OUT THE INVENTION

Figure 1:
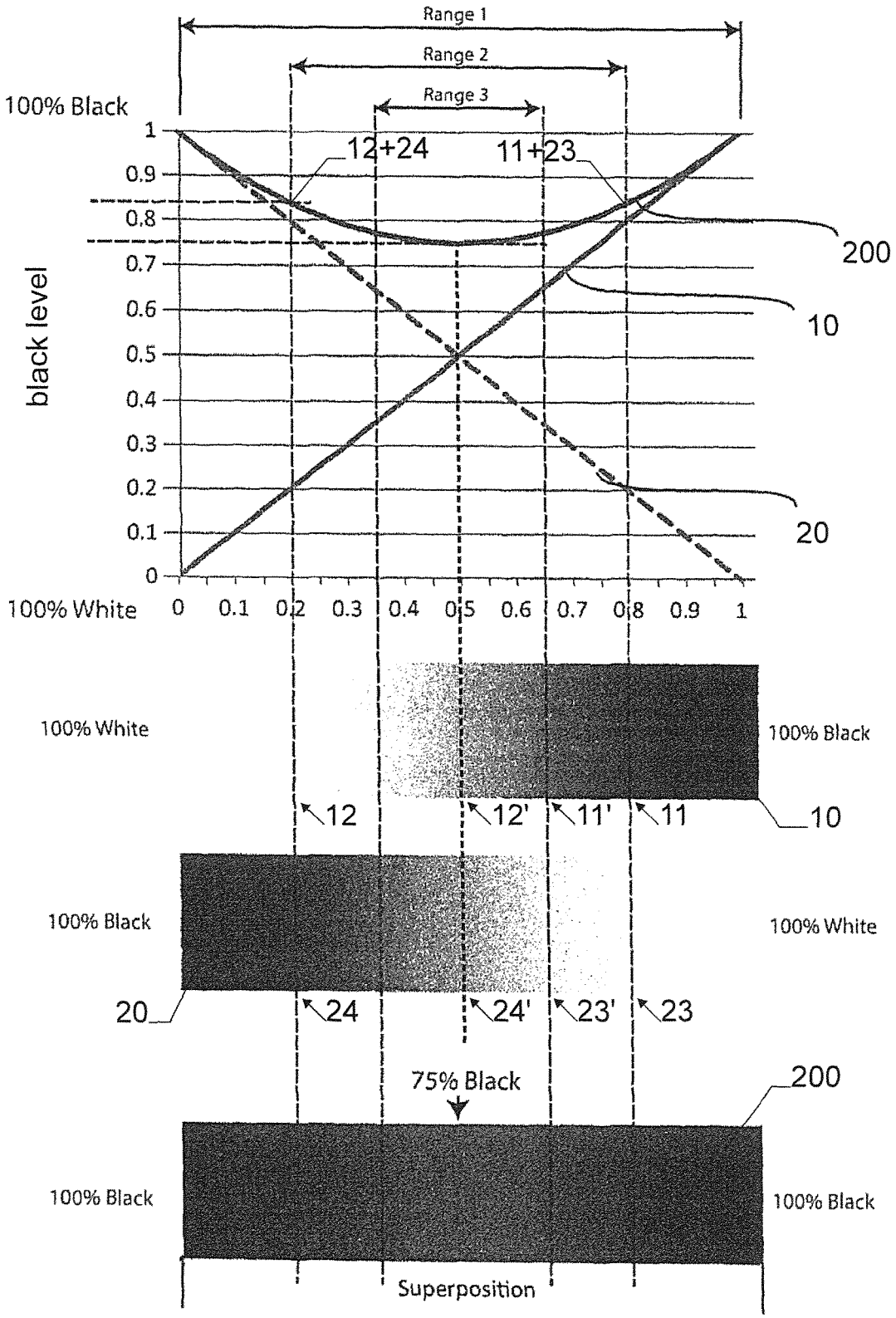
FIG. 1 shows—as a technological background—a first pattern 10 and a second pattern 20 as well as a combination 200 of this first pattern 10 with this second pattern 20 in a transmission viewing mode.

FIG. 1 shows a first pattern 10 and a second pattern 20. In this figure, the first pattern 10 is a grayscale image with a gradient from 100% white (i.e., 0% black) to 100% black (from left to right). The second pattern 20 is an inverted pattern with regard to the first pattern 10, i.e., it is a grayscale image with a gradient from 100% black to 0% black.

When the first pattern 10 is overlaid with the second pattern 20 (i.e., when a first region 11 fully coincides with a third region 23 and a second region 12 fully coincides with fourth region 24) and viewed in a transmission viewing mode, a grayscale image 200 as depicted in the lower part of FIG. 1 is observed. Specifically, a grayscale image going from 100% black to 75% black back to 100% black is yielded.

The upper part of FIG. 1 shows the black levels of the single patterns 10 and 20 as well as of the combined grayscale image 200 (in transmission viewing mode) as functions of position.

What can be seen from the diagram is that in the transmission viewing mode (i.e., with transmissions through the first and through the second pattern being combined), the first region 11 is indiscernible from the second region 12 of the first pattern 10, because both the first region 11 and the second region 12 show the same gray levels of 84% black (see the points labeled 12+24 and 11+23 of the curve labeled 200 in the diagram).

This is, because the first region 11 of the first pattern 10 fully coincides with the third region 23 of the second pattern 20 (see vertical line). Similarly, the second region 12 of the first pattern 10 fully coincides with the fourth region 24 of the second pattern (see vertical line). Furthermore, the first pattern 10 (i.e., all regions) is inverted with respect to the second pattern 20, i.e., the third region 23 is inverted with respect to the first region 11 and the fourth region 24 is inverted with respect to the second region 12.

One possible theoretical approach to explain this is the so-called Demichel equation. For 2 colors, the Demichel equation shows that for the superposition of a layer of color C1 with a density d1 and of a layer of color C2 with a density d2 (both layers having a random halftoning), a surface coverage of white w=(1−d1)×(1−d2), a perceived color C1=d1×(1−d2), and a perceived color C2=d2×(1−d1).

If both colors C1 and C2 are black and if d2=1−d1 (inverted patterns!), the density of black b (i.e., b=1−w) for the superposed image equals to b=1−d1+d12. This corresponds to the curve labeled 200 in the diagram of FIG. 1.

As an example, the first region 11 of the first pattern 10 and the fourth region 24 of the second pattern 20 are both 80% black. The second region 12 of the first pattern 10 and the third region 23 of the second pattern 20 are both 20% black, i.e., inverted. Hence, the first region 11 has a different transmittance and reflectivity than the second region 12 and the third region 23 has a different transmittance and reflectivity than the fourth region 24. The superposition of the first region 11 with the third region 23 yields b=1−0.8+0.82, i.e., b=84% black. This is the same value as for the superposition of the second region 12 with the fourth region 24, namely b=1−0.2+0.22=84% black. Note that a 100%) transmittance of the substrate is assumed here (substrate not shown!).

Thus, in a transmission viewing mode (i.e., in a superposition of the first pattern 10 with the second pattern 20), the first region 11 is indiscernible from the second region 12 and the third region 23 is indiscernible from the fourth region 24.

As can be further seen from the Demichel equation:

With the full range of grayscales (see range 1), the perceived black level of the superposed inversed patterns 10, 20 in transmission viewing mode ranges between b=100%) and 75%.

With a smaller range of grayscales (see range 2) such as 0.2 to 0.8 (i.e., the example above), the perceived black level of the superposed inversed images ranges between b=84% and 75% (horizontal dashed lines).

With an even smaller range of grayscales (see range 3) such as 0.35 to 0.65, the perceived black level of the superposed inversed images ranges between b=77.25% and 75%. This is a range of black levels b where the black levels are not distinguishable by the naked eye of a viewer without visual aids. Thus, in this example, in a transmission viewing mode through first pattern 10 and second pattern 20, a first region 11' would be indiscernible from a second region 12'. In general, it can be stated that regions with transmitted light intensity-differences below 5% cannot be discerned.

If the first pattern 10 is viewed in a reflection viewing mode (e.g., with an overall reflected light intensity from the first pattern 11 outshining an overall transmitted light intensity at least by a factor of 5), the full superposition of the first pattern 10 with the second pattern 20 does not take place any more and the first region 11 thus becomes discernible from the second region 12 due to their different reflectivities. In general, it can be stated that regions with reflected light intensity-differences above 5% can be discerned.

Thus, very specific patterns can be created under different viewing conditions and security in enhanced.

Figure 2:
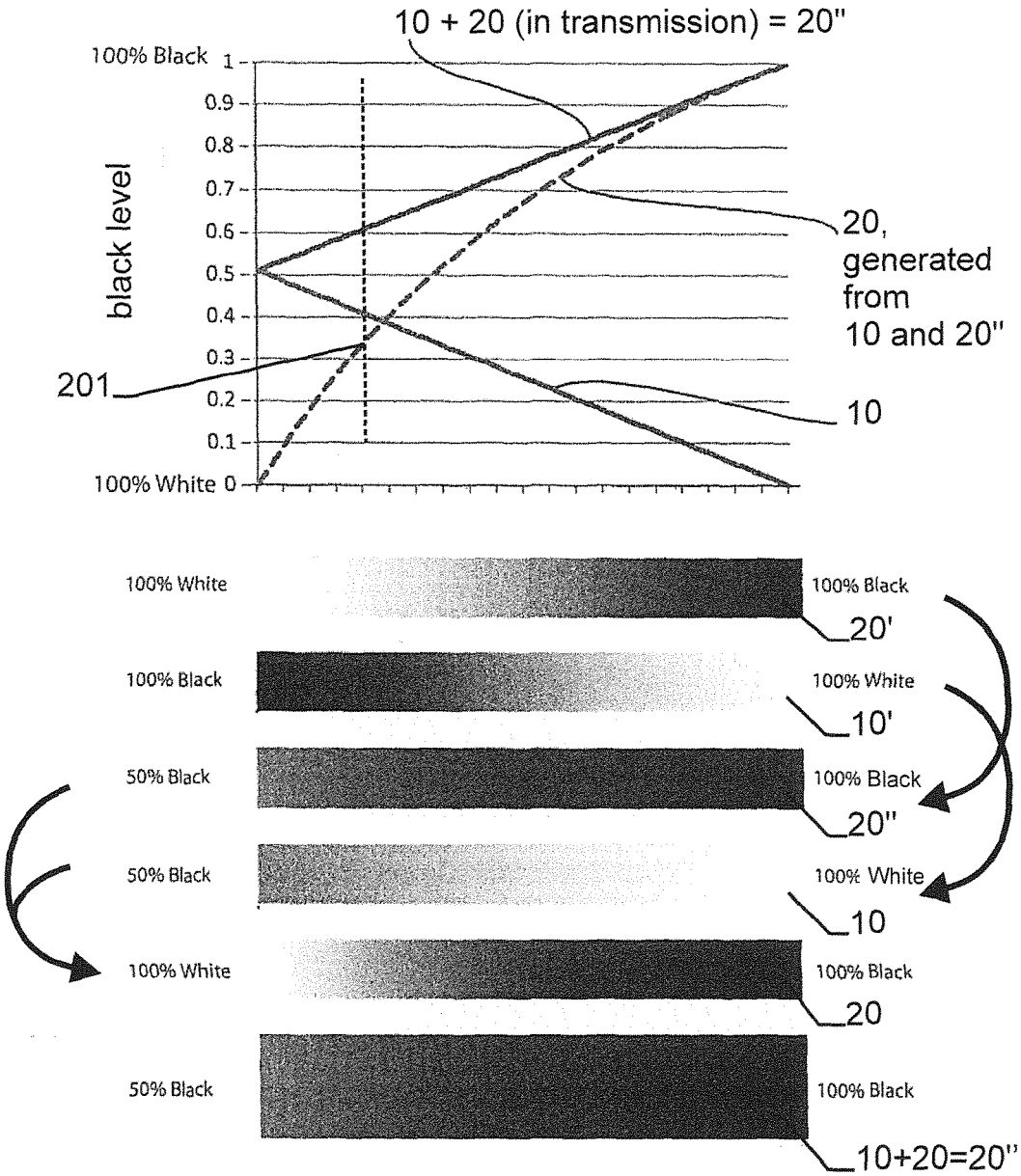
FIG. 2 shows a generation of a first pattern 10 and of a second pattern 20 for use in a security device 1 according, to a first embodiment of the invention.

While FIG. 1 explains the technological background, in FIG. 2, the generation of a first pattern 10 and of a second pattern 20 for use in a security device 1 according to a first embodiment of the invention is explained.

FIG. 2 shows a second seed pattern 20' from 100% white to 100% black and it shows a first seed pattern 10' from 100% black to 100% white (as seen from left to right). So far, the situation is the same as discussed above with regard to FIG. 1.

Now, here, instead of using these seed patterns 10' and 20' directly for applying onto a substrate 2 of a security device 1 (both not shown), the brightness and contrast of the second seed pattern 20' is modified to ensure that all grayscale levels are darker than 50% black. In other words, a its histogram of color densities (gray levels) is shrunken. Thus, an intermediate pattern 20" is yielded. In other words, in a histogram of this intermediate pattern 20", only black levels between 50% black and 100% black are populated while the gray levels between 0% black and 50% black are unpopulated (i.e., only regions with gray values between 50% black and 100% black are present in the intermediate pattern 20").

Furthermore, the brightness and contrast of the first seed pattern 10' is modified to ensure that the grayscale level is brighter than 50% black. Thus, the first pattern 10 is yielded which is to be arranged on a first surface 3 of a security device substrate 2 (not shown). In other words, in a histogram of this first pattern 10, only black levels between 0% black and 50% black are populated while the gray levels between 50% black and 100% black are unpopulated.

Now, as a next step, a second pattern 20 is generated using the first pattern 10 and the intermediate pattern 20". The second pattern 20 (which is to be arranged on a second surface 4 of a security device substrate 2) is created such that in a transmission viewing mode in combination with the first pattern 10, the intermediate pattern 20" is yielded when a perfect 100% transmittance of the substrate is assumed. This intermediate pattern 20", however, corresponds to the second seed pattern 20' with the exception of a modified brightness and contrast.

The diagram at the top of FIG. 2 shows these relations.

This last step of generating the second pattern 20 is carried out by using the Demichel equation as explained above with regard to FIG. 1. Specifically, the Demichel equation as introduced above for a layer of color C1 (black in this case) with a density d1 and of a layer of color C2 (black in this case) with a density d2 tells how to do this generation step: It states that $$b=1-(1-d1)*(1-d2)=1-(1-d2-d1+d2d1) \quad (1)$$

$$b=d1+d2-d1d2 \quad (2)$$

Here, b is again indicative of the density of black for the transmission-superposed pattern 10+20=20".

In other words, the black level in a specific region of the to be generated second pattern 20 can be calculated by $$d2=1-(1-b)/(1-d1) \quad (3)$$

For an example, please refer to the dashed vertical line in the diagram on top of FIG. 2: In the specific region of the patterns, the first pattern 10 has a gray level of 40%. Now, the task is to find a second pattern 20 (i.e., its gray level in this region) that combines (in transmission) with the first pattern to yield a gray level of 60% (i.e., the gray level of the intermediate pattern 20" in the respective region). So, with b=0.6 and d1=0.4, it follows that $$d2=1-(1-0.6)/(1-0.4)=0.33=33\% \text{ black} \quad (4)$$

This corresponds to point 201 on the pattern-20-curve in the diagram of FIG. 2.

For a pattern generation rule, we need to impose that d2>=0. This leads to $$(1-b)/(1-d1)<1 \text{ or}$$

$$d1<b. \quad (5)$$

This means, however, that a gray level of any region of the first pattern 10 (i.e., d1) is always brighter than a corresponding gray level of a region of the intermediate pattern 20" at the same position. In other words, the color density d1 of the first pattern 10 is in a range between 0% (0.0) and a given density level, while the color densities b of the intermediate pattern are in a range between said given density level and 100% (1.0)

For this to be taken into account, the step of histogram-shrinking is used, if necessary.

In the examples herein, two equal ranges for d1 (i.e., black levels in the first pattern 10) and b (i.e., black levels in the intermediate pattern 20") such as 0-50% for d1 and 50%-100% for b are selected. Other ranges are possible as well.

As an effect, first and second patterns 10, 20 which are to be arranged on a first and second surface 3,4 of a security device substrate 2 are easier to generate.

Note that the above discussed approach also works in color:

Demichel equation in CMYK:

$$C\text{cyan}=d\text{cyan}\times(1-d\text{magenta})\times(1-d\text{yellow})\times(1-d\text{black})$$

$$C\text{magenta}=d\text{magenta}\times(1-d\text{cyan})\times(1-d\text{yellow})\times(1-d\text{black})$$

$$C\text{yellow}=d\text{yellow}\times(1-d\text{cyan})\times(1-d\text{magenta})\times(1-d\text{black})$$

$$C\text{cyanmagenta}=d\text{cyan}\times d\text{magenta}\times(1-d\text{yellow})\times(1-d\text{black})$$

$$C\text{cyanyellow}=d\text{cyan}\times(1-d\text{magenta})\times d\text{yellow}\times(1-d\text{black})$$

$$C\text{magentayellow}=d\text{magenta}\times(1-d\text{cyan})\times d\text{yellow}\times(1-d\text{black})$$

$$C\text{black}=(1-d\text{cyan})\times(1-d\text{magenta})\times(1-d\text{yellow})\times d\text{black}$$

$$+d\text{cyan}\times d\text{magenta}\times d\text{yellow}\times(1-d\text{black})$$

$$+d\text{cyan}\times d\text{magenta}\times d\text{yellow}\times d\text{black}$$

$$+d\text{cyan}\times(1-d\text{magenta})\times(1-d\text{yellow})\times d\text{black}$$

$$+d\text{magenta}\times(1-d\text{cyan})\times(1-d\text{yellow})\times d\text{black}$$

$$+d\text{yellow}\times(1-d\text{cyan})\times(1-d\text{magenta})\times d\text{black}$$

$$+d\text{cyan}\times d\text{magenta}\times(1-d\text{yellow})\times d\text{black}$$

$$+d\text{cyan}\times(1-d\text{magenta})\times d\text{yellow}\times d\text{black}$$

$$+d\text{magenta}\times(1-d\text{cyan})\times d\text{yellow}\times d\text{black}$$

If cyanmagentayellow=black $$C\text{white}=(1-d\text{cyan})\times(1-d\text{magenta})\times(1-d\text{yellow})\times(1-d\text{black})$$

Figure 3:
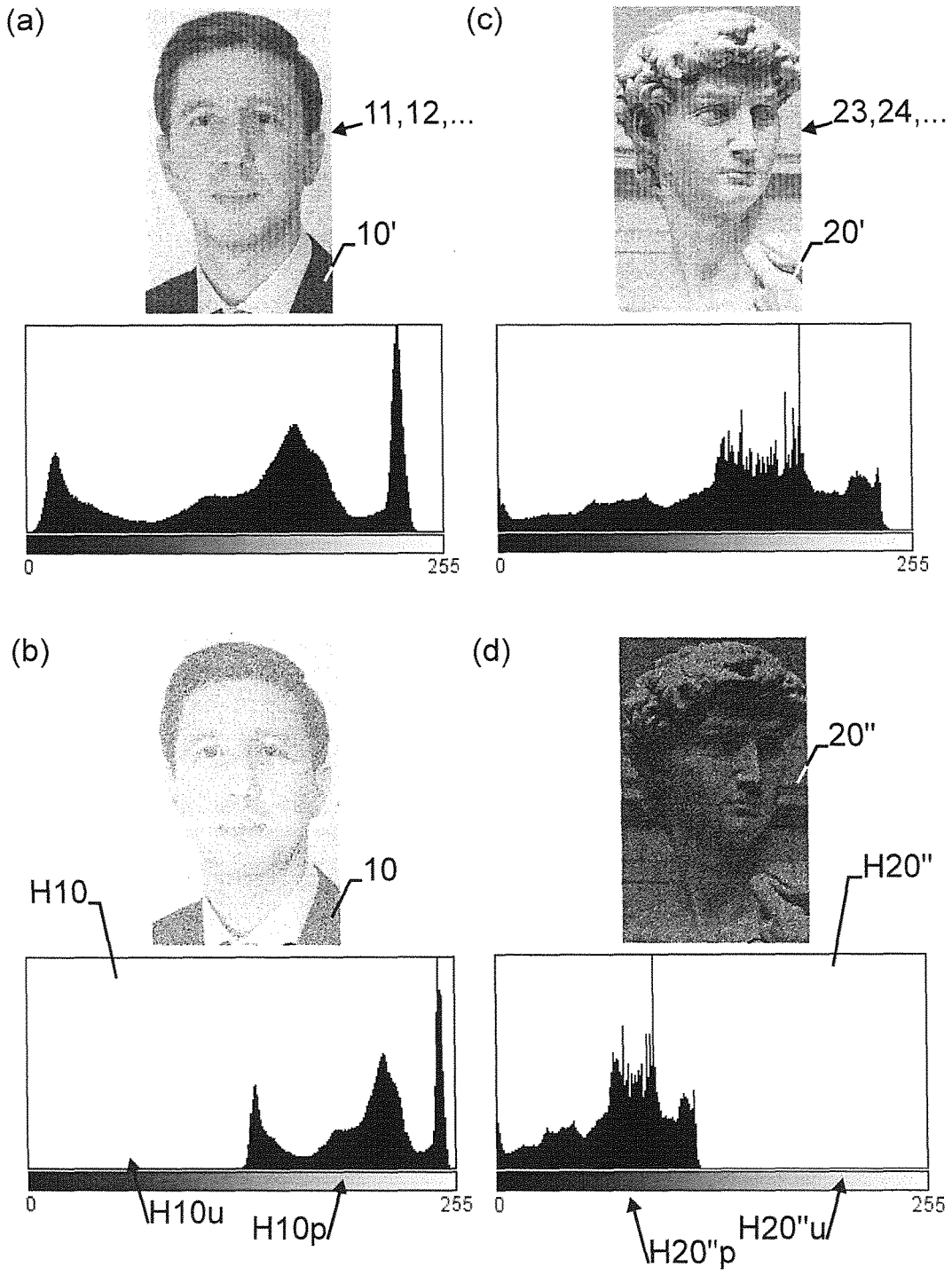
FIG. 3 shows a derivation of a first pattern 10 using a first seed pattern 10' and the derivation of an intermediate pattern 20" using a second seed pattern 20'.

FIG. 3 shows the derivation of a first pattern 10 using a first seed pattern 10' and the derivation of an intermediate pattern 20" using a second seed pattern 20'.

In contrast to the gray wedges as discussed above with regard to FIG. 2, here, the first seed pattern 10' comprises an 8-bit grayscale image of the inventor with a plurality of pixels (regions) 11, 12, . . . . The second seed pattern 20' comprises an 8-bit grayscale image of a statue with a plurality of pixels (regions) 23, 24, . . . .

As can be seen from panels (a) and (b), a brightness and a contrast of the first seed pattern 10' are modified for yielding the first pattern 10, which is to be arranged on the first surface 3 of a security device substrate 2 (not shown). A first histogram H10 of the first pattern 10 comprises a first unpopulated region H10*u* below gray levels of 127 and a first populated region H10*p* above gray levels of 128.

Panels (c) and (d) show a generation of an intermediate pattern 20" using a second seed pattern 20'. Specifically, a brightness and a contrast of the second seed pattern 20' are modified for yielding the intermediate pattern 20", which is later used for generating the second pattern 20, which is to be arranged on the second surface 4 of a security device substrate 2 (not shown). A second histogram H20" of the intermediate pattern 20 comprises a second unpopulated region H20"*u* above gray levels of 128 and a first populated region H20"*p* below gray levels of 127.

Figure 4:
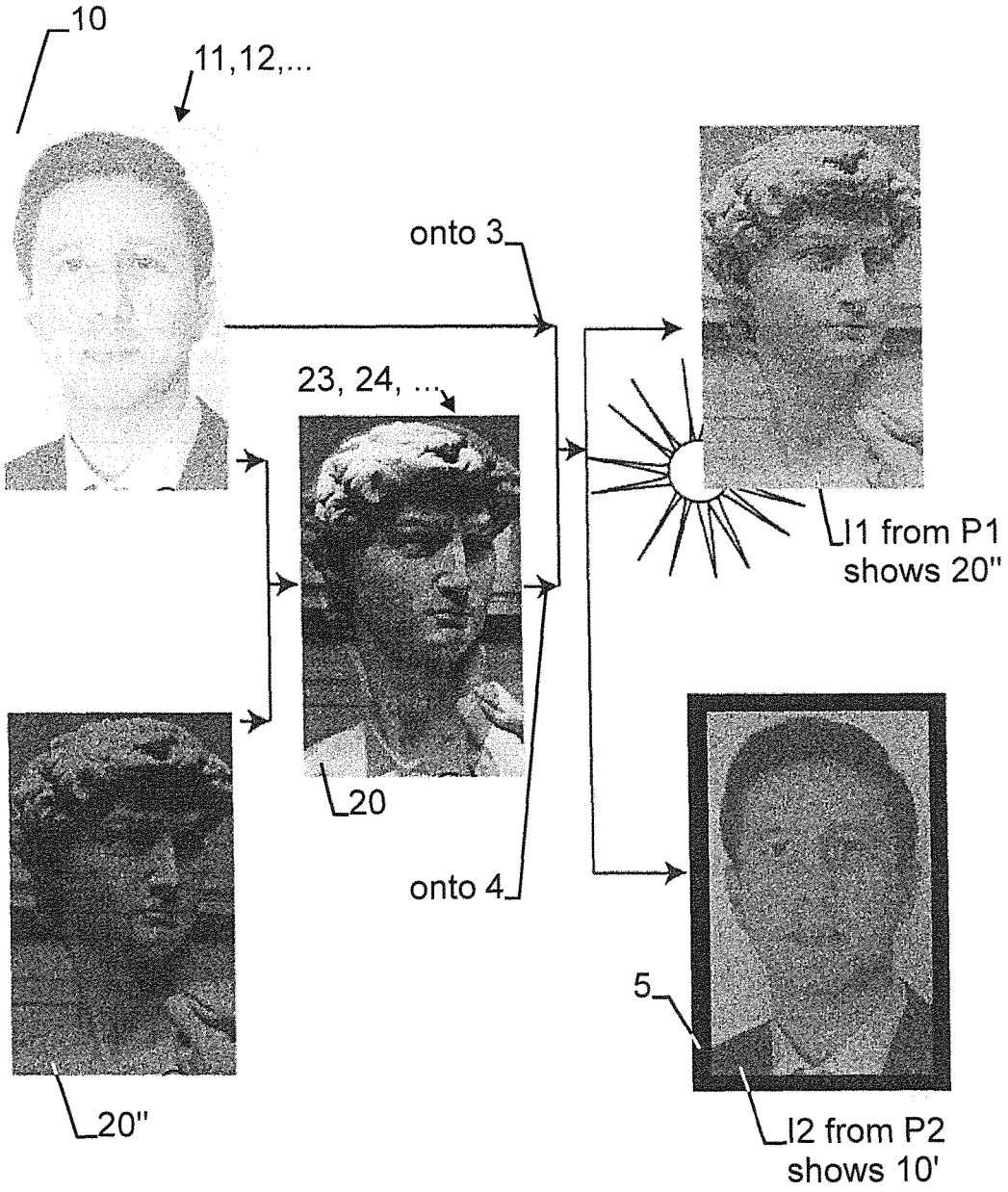
FIG. 4 shows a combination of the first pattern 10 and of the intermediate pattern 20" of FIG. 3 for yielding a second pattern 20 for use in a security device 1 according to a second embodiment of the invention.

FIG. 4 shows a combination of the first pattern 10 and of the intermediate pattern 20" of FIG. 3 for yielding a second pattern 20. Then, the first pattern 10 is applied onto a first surface 3 of a substrate 2 of a security device 1 (not shown) and the second pattern 20 is applied onto a second surface 4 of said substrate 2. As it can be seen from the second pattern 20 (e.g., in the lower part comprising the collar of the inventor), an inversion of the first seed pattern 10' is comprised in the second pattern 20. This is, however, an outcome of the pattern-generation step as discussed above. In a transmission viewing mode (I1 from P1, top in right column of the figure), the intermediate pattern 20" is visible whereas in a reflection viewing mode (I2 from P2 which is the same as P1 in this case, bottom in right column of the figure), the first seed pattern 10' is visible. Note that for simplifying the reflection viewing mode and to achieve further attenuation effects of the second pattern 20 (see below), here, a light absorber 5 is arranged behind the second surface 4 of the substrate 2 in the reflection viewing mode, i.e., the first pattern 10 faces the second viewing position P2).

Figure 5:
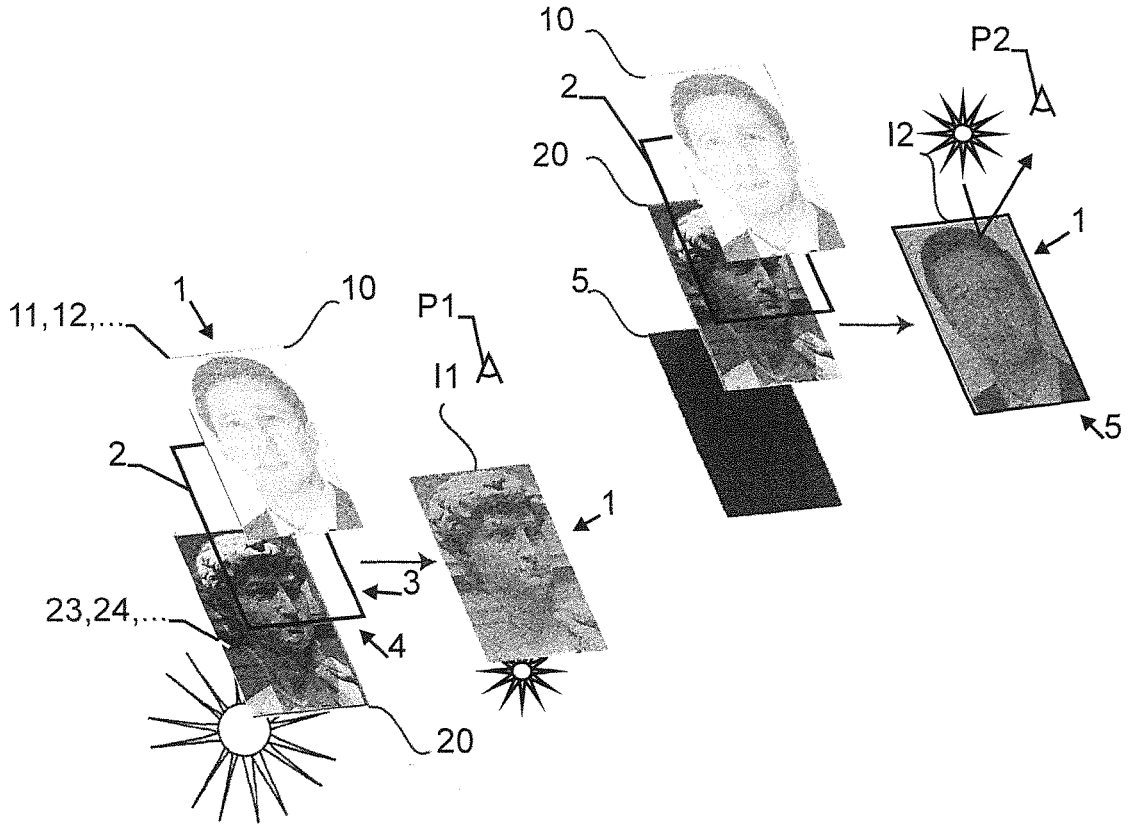
FIG. 5 shows a security device 1 according to the second embodiment of the invention, the security device 1 comprising the first pattern 10 and the second pattern 20 of FIG. 4.

FIG. 5 shows the use of the first pattern 10 and of the second pattern 20 of FIG. 4 in a security device 1. The first pattern 10 ("inventor") is applied onto a first surface 3 of the substrate 2 and a second pattern 20 (generated as discussed above using the "inventor"-image and the "statue"-image) is applied onto a second opposite surface 4 of the substrate 2. The first and second patterns 10, 20 are advantageously applied using a high registration printing process. Thus, the above-discussed visual effects in different viewing modes are easier to achieve and security is enhanced.

As can be seen from the right panel on the left hand side of the figure, a first image I1 which is taken from a first viewing position P1 in a transmission viewing mode only shows the second seed pattern 20' (statue).

However, as can be seen from the right panel on the right hand side of the figure, in a reflection viewing mode (second image I2 from a second viewing position P2), which is here facilitated by overlaying the security device 1 with a light absorber 5, only the first seed pattern 10' ("inventor") is visible.

Thus, specific visual effects are created and the security is enhanced.

Figure 6A:
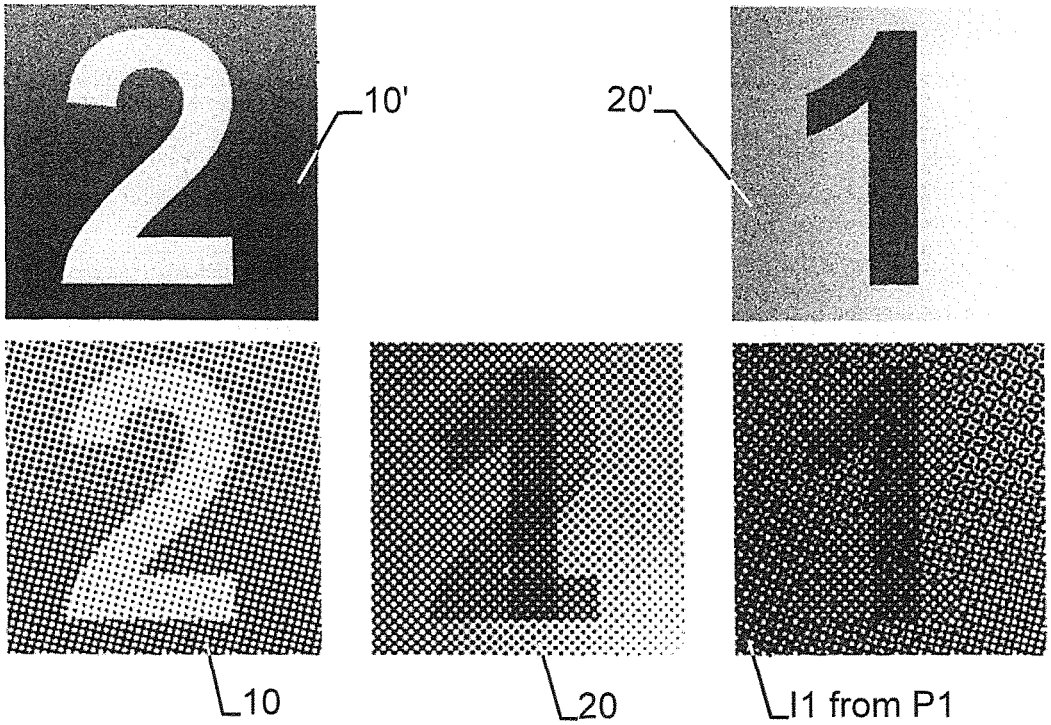
FIG. 6*a* shows a first halftoned pattern 10 and a second halftoned pattern 20 for use in a security device 1 according to a third embodiment of the invention as well as combination of the first pattern 10 and of the second pattern 20 in a transmission viewing mode.

FIG. 6*a* shows a derivation of a first pattern 10 from a first seed pattern 10'. Here, in addition to the steps as described above with regard to FIGS. 2 and 3, a halftoning is used after modifying the brightness and contrast of the first seed pattern 10'. Furthermore, the figure shows a second pattern 20 for use in a security device 1 according to a third embodiment of the invention. The second pattern 20 is derivable using the first pattern 10 and using an intermediate pattern 20" (not shown) with the pattern generation rule as described above. Here, in addition to the steps as described above with regard to FIGS. 2 and 3, an additional halftoning is applied to the intermediate pattern 20" after modifying the brightness and contrast of the second seed pattern 20' (not shown). The lower right panel of the figure shows that in a transmission viewing mode (image I1 from a viewer's first viewing position P1), only the second seed pattern 20' is visible.

Figure 6B:
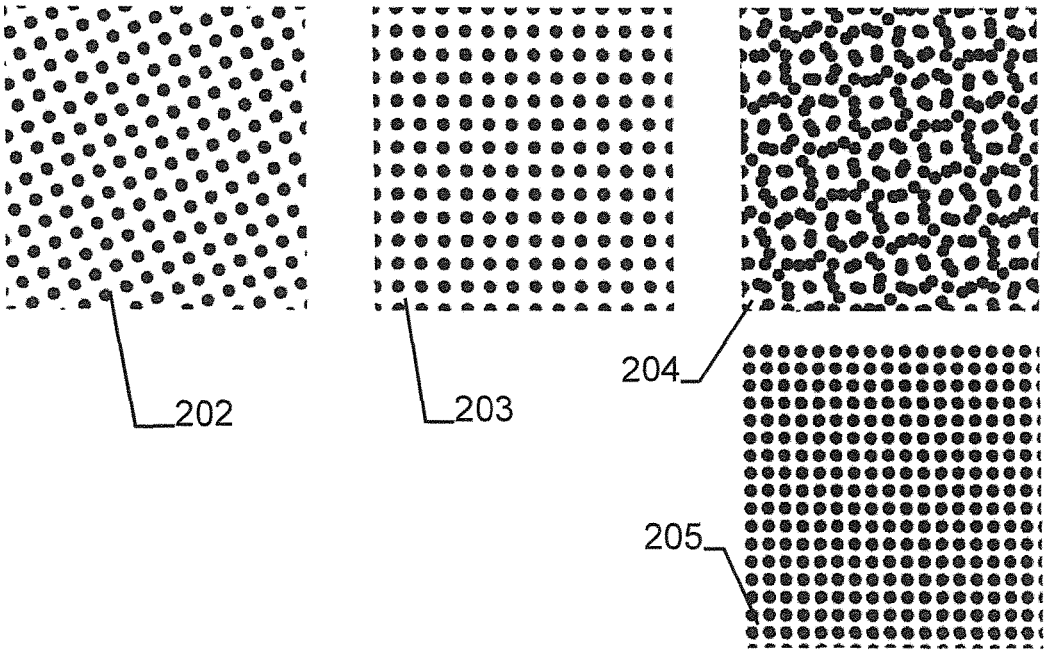
FIG. 6*b* shows different halftoning patterns 202 and 203 as used in FIG. 6*a*, FIG. 7 schematically shows a security document 100 comprising the security device 1 of FIG. 5, a light absorber 5, and a folding line 500, FIG. 8 schematically shows the security device 1 of FIG. 5 in a transmission viewing mode, FIG. 9 schematically shows the security device 1 of FIG. 5 in a reflection viewing mode with specular reflection, and FIG. 10 schematically shows the security device 1 of FIG. 5 in a reflection viewing mode with specular reflection and second pattern attenuation by a light absorber 5.

FIG. 6*b* shows different halftoning patterns 202 and 203 which are used for the derivation of the first and second patterns 10, 20 of FIG. 6*a*. Specifically, the first halftoning pattern 202 with a constant frequency is used for yielding the first pattern 10 of FIG. 6*a*. The second halftoning pattern 203 with the same constant frequency but a rotated angle is used for yielding the intermediate pattern 20" and therefore the second pattern 20 of FIG. 6*a*. A superposition pattern 204 of the first and the second halftoning patterns 202, 203 as well as a third halftoning pattern 205 with a surface coverage equal to the superposition pattern 204 but with a constant frequency are shown for comparison.

The use of halftoning patterns simplifies the manufacturing of the security device.

Figure 7:
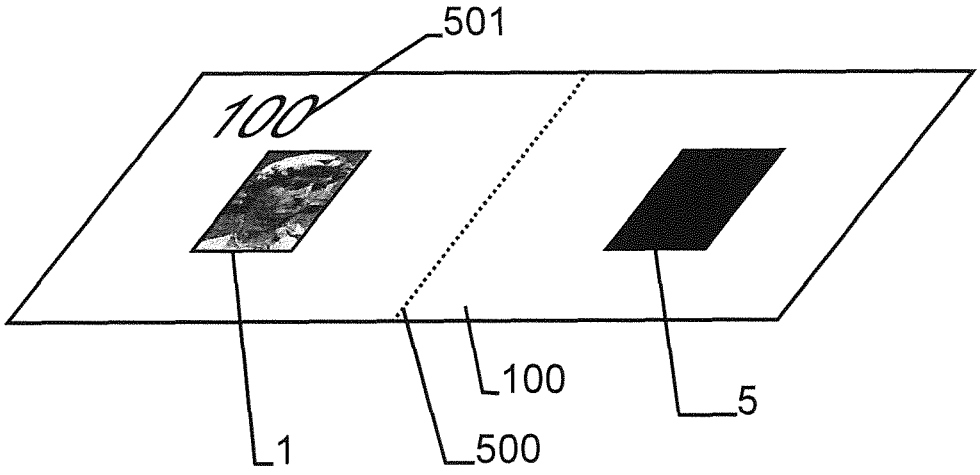

FIG. 7 schematically shows a security document 100 (a banknote with a denomination 501) comprising the security device 1 of FIG. 5. The security device 1 is arranged in a window of the security document 100 and a light absorber 5 consisting of a region with 100% black is arranged at a distance to the security device 1. If the security document 100 is folded along a folding line 500, the light absorber 5 can be brought into overlap with the security device 1 and thus a reflection viewing mode is easier to achieve (also see below for attenuation effects).

Figure 8:
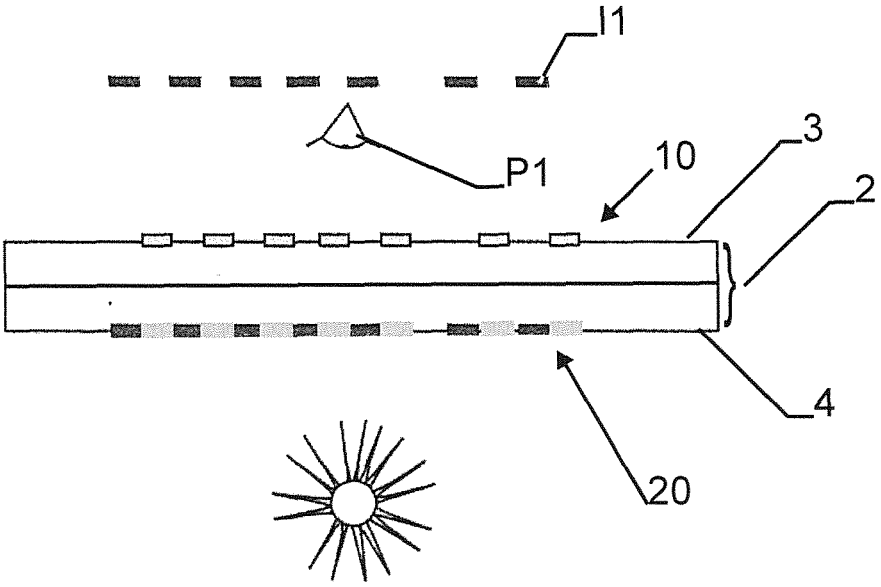

FIG. 8 schematically shows the security device 1 of FIG. 5 in a transmission viewing mode. The security device 1 comprises the transparent multilayer substrate 2 with the first surface 3 and the second surface 4. The first pattern 10 ("inventor") is arranged on the first surface 3 (only schematically shown). The second pattern 20 (generated using the first pattern 10 and using the intermediate pattern 20" ("statue") as discussed above) is arranged on the second surface 4 (only schematically shown). In a transmission viewing mode (image I1 at a viewer's first viewing position P1), for at least one transmitted wavelength through said security device, only the second seed pattern 20" ("statue") is visible because the contributions of the "inventor" pattern in the first pattern 10 and in the second pattern 20" cancel out each other according to the Demichel equation as discussed above. In other words, the first pattern 10 ("inventor") is invisible in the transmission viewing mode, because combined perceived grayscale differences for the "inventor" pixels are below a discernible threshold, just as the regions 11' and 12' in FIG. 1.

Figure 9:
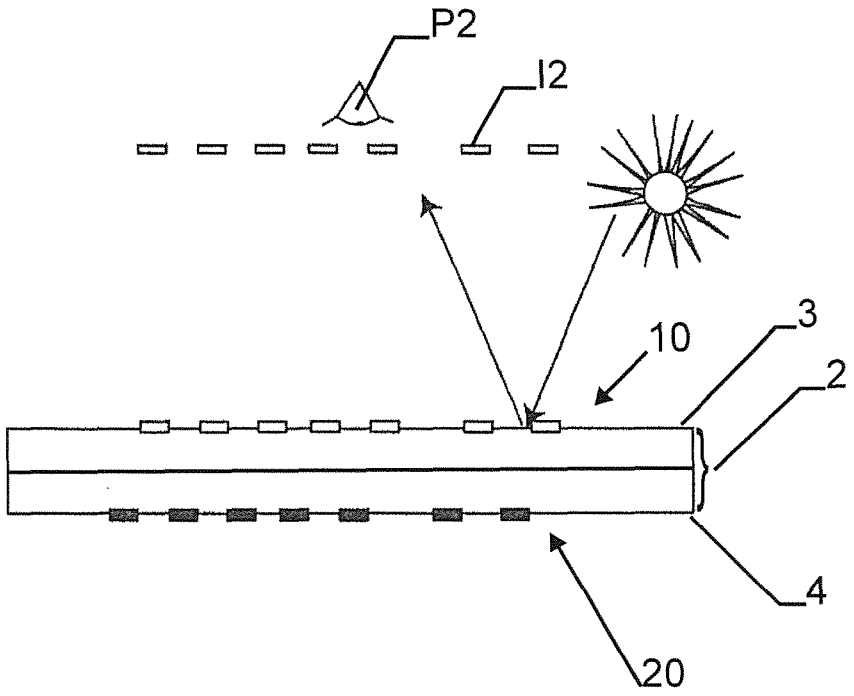

FIG. 9 schematically shows the security device 1 of FIG. 5 in a reflection viewing mode with specular reflection only. In such a reflection viewing mode (image I2 at a viewer's second viewing position P2), for at least one (specularly by the first surface 3) reflected wavelength from the first pattern 10, only the first pattern 10 ("inventor") is visible. This is because, in this model, almost all light is reflected from the first pattern 10 or from the first surface 3. Thus, the second pattern 20 does not interact with the light.

Figure 10:
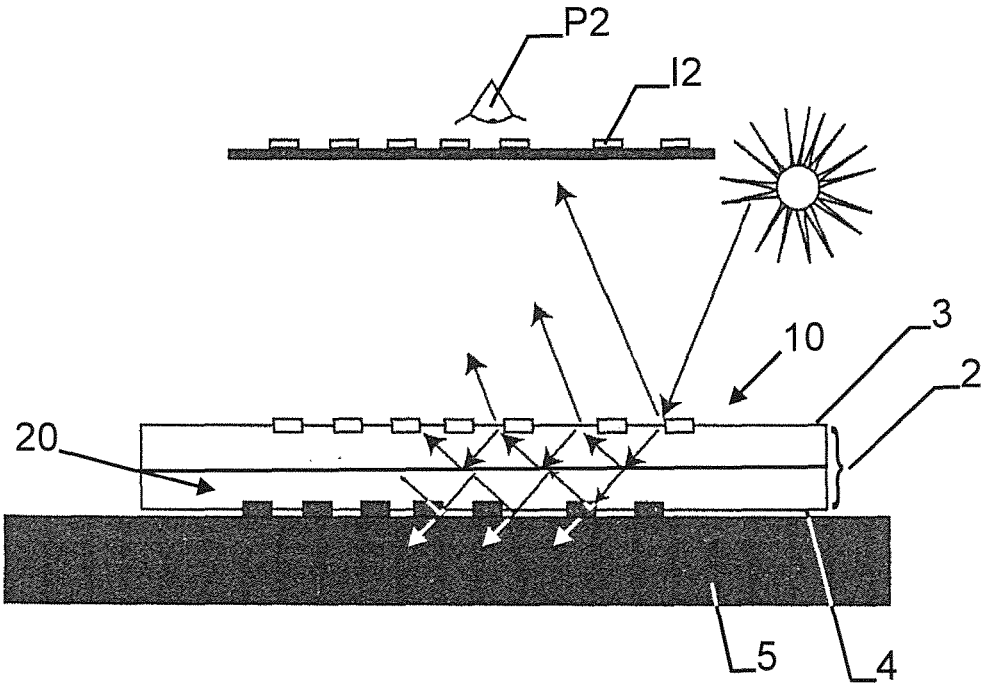

FIG. 10 schematically shows the security device 1 of FIG. 5 in a reflection viewing mode with specular reflection and second pattern attenuation which is facilitated by a light absorber 5. The situation is essentially the same as in FIG. 9, but in addition to only specular reflection on the first surface 3, a light absorber 5 is arranged at the second surface 4 and helps to attenuate the second pattern 20. This is due to the propagation of light and the multiple reflections of the light inside the substrate 2.

In the embodiments described above, substrate 2 is assumed to be specularly reflecting. Further, any reflection of the substrate is neglected e.g. in the calculations of Eq. (1)-(3).

In another embodiment, substrate 2 can also be diffusely reflecting, as mentioned above.

Advantageously, substrate 2 is uniformly reflecting over the whole area of the first and second seed patterns.

Further, it must be noted that Eq. (1)-(3) can be refined to take the reflection r or transmission t of substrate 2 into account. In this case, Eq. (1) and (3) become, when neglecting multiple reflections.

$$b=1-(1-d1)*(1-d2)=1-(1-d2-d1+d2d) \quad (1')$$

$$d2=1-(1-b)/(1-d1)/t \quad (3')$$

The above equations must be approximately fulfilled for each location where the two patterns overlap in order to see the intermediate pattern b in transmission.

In this case, the condition of Eq. (5) is changed to $$1-t+t*d1<b \quad (5')$$

For example, for t=0.8, and if we assume that b>50% (0.5), we have d1<38% (0.38).

In other words, for the at least one wavelength and for values t<1, the color density d1 of the first pattern 10 is in a range between 0% (0.0) and a first given density level, while the color densities b of the intermediate pattern are in a range between a second given density level and 100% (1.0), with the first given density level being smaller than the second given density level.

Remark:

While there are shown and described presently preferred embodiments of the invention, it is to be distinctly understood that the invention is not limited thereto but may be otherwise variously embodied and practiced within the scope of the following claims.

The invention claimed is:

1. A method for generating a security device comprising the steps of:

providing a first non-uniform grayscale or color image, providing a second non-uniform grayscale or color image, modifying a brightness and/or a contrast of said first grayscale or color image for yielding a first pattern, wherein said first pattern has a plurality of color densities d1 in a range between 0% and a given density level, modifying a brightness and/or a contrast of said second grayscale or color image for yielding an intermediate pattern, wherein said intermediate pattern has a plurality of color densities b in a range between said given density level and 100%, mathematically superimposing said first pattern and said intermediate pattern and generating a second pattern having, for each location of the superimposed first pattern and intermediate pattern, color densities $d2=1-(1-b)/[t*(1-d1)]$, with t being a factor between 0.5-1.0, applying said first pattern to a first side of an at least partially transparent substrate (2) that is partially reflecting in a reflection viewing mode, and applying said second pattern to a second side of said substrate in register to said first pattern.

2. The method of claim 1, wherein said given density level is larger than 0% and smaller than 90%.

3. The method of claim 1 wherein said factor t is between 0.5 and 0.9 and corresponds to the transmission of said substrate.

4. The method of claim 1, wherein said factor t is 1.

5. The method of claim 1 further comprising steps of halftoning said first pattern, and halftoning said intermediate pattern or said second pattern.

6. The method of claim 1 wherein said given density level is in a range between 10% and 90%.

7. The method of claim 1 wherein said given density level is 50%.

* * * * *